US010106356B2

(12) United States Patent
Kröhnert et al.

(10) Patent No.: US 10,106,356 B2
(45) Date of Patent: Oct. 23, 2018

(54) DEVICE FOR CUTTING PAPER WEBS

(75) Inventors: René Kröhnert, Lichtenberg (DE); Wolfgang Freyer, Grosshöchstetten (CH); Beat Kipfer, Ostermundigen (CH)

(73) Assignee: KERN AG, Konolfingen (CH)

( * ) Notice: Subject to any disclaimer, the term of this patent is extended or adjusted under 35 U.S.C. 154(b) by 262 days.

(21) Appl. No.: 13/499,996

(22) PCT Filed: Oct. 6, 2009

(86) PCT No.: PCT/EP2009/062948

§ 371 (c)(1),
(2), (4) Date: Apr. 3, 2012

(87) PCT Pub. No.: WO2011/042047

PCT Pub. Date: Apr. 14, 2011

(65) Prior Publication Data

US 2012/0222528 A1 Sep. 6, 2012

(51) Int. Cl.
*B65H 20/32* (2006.01)
*B65H 20/24* (2006.01)

(52) U.S. Cl.
CPC ..... *B65H 20/32* (2013.01); *B65H 20/24* (2013.01); *B65H 2301/4148* (2013.01);
(Continued)

(58) Field of Classification Search
CPC .. B65H 2408/215; B65H 20/32; B65H 20/24; B65H 2301/4148; B65H 20/02;
(Continued)

(56) References Cited

U.S. PATENT DOCUMENTS 1,479,464 A * 1/1924 Fuller, Jr. ..... C14B 5/00 144/245.4
3,599,521 A * 8/1971 Lee ..... G03D 15/04 83/210

(Continued)

FOREIGN PATENT DOCUMENTS

DE 2548652 A1 * 5/1976
DE 19516871 A1 * 11/1996 ..... B65B 9/20

(Continued)

OTHER PUBLICATIONS

English Translation of DE19516871.*

(Continued)

*Primary Examiner* — Jennifer Swinney
(74) *Attorney, Agent, or Firm* — Pearne & Gordon LLP

(57) ABSTRACT

A device for cutting paper webs comprises a substantially continuously operated region of a papers supply, a discontinuously operated region of transverse severing of a separating the paper web, and a buffer region (15) for coupling the continuously and discontinuously operated regions. At least one receptacle (17) open at the top is provided in the buffer region, into which the paper web(s) (3, 3') are guided so as to be looped in a freely suspended manner. The buffer region is arranged after a longitudinal cutting device (9) for producing at least two longitudinal webs (3, 3'), whereby at least two webs extending separately and adjacently to one another are guided in the receptacle or at least two receptacles are arranged adjacently to one another or adjacently to one another at an offset, wherein the paper webs are guided into the receptacles.

14 Claims, 3 Drawing Sheets

(52) U.S. Cl.
CPC ..... *B65H 2408/215* (2013.01); *Y10T 83/0448* (2015.04); *Y10T 83/0453* (2015.04); *Y10T 83/207* (2015.04); *Y10T 83/2066* (2015.04); *Y10T 83/2083* (2015.04); *Y10T 83/2196* (2015.04); *Y10T 83/2207* (2015.04)

(58) Field of Classification Search
CPC ..... B65H 20/04; B65B 41/169; B65B 41/18; B65B 61/06
USPC ..... 83/27, 408, 60, 100, 367, 498, 499, 506, 83/344, 364, 261; 53/389.3, 389.4; 198/832.2; 270/1.01–1.03, 52.07
See application file for complete search history.

(56) References Cited

U.S. PATENT DOCUMENTS 3,659,839 A * 5/1972 Baucke ..... 271/183
3,728,920 A * 4/1973 Gardner ..... B41J 11/70 83/106
3,799,419 A * 3/1974 Herzhoff et al. ..... 226/11
3,807,612 A * 4/1974 Eggert ..... B65H 20/04 226/111
3,882,744 A * 5/1975 McCarroll ..... G03G 15/6523 83/262
3,998,116 A * 12/1976 Helm ..... 83/98
4,070,951 A * 1/1978 Bala ..... B65H 20/24 226/113
4,173,301 A * 11/1979 Turini ..... B65H 29/241 226/102
4,273,324 A * 6/1981 Philipp ..... B65H 29/242 271/183
4,527,346 A * 7/1985 Schwartzott ..... A41H 43/005 112/DIG. 2
4,561,581 A * 12/1985 Kelly ..... 226/113
4,655,067 A * 4/1987 Frost et al. ..... 72/131
4,941,606 A * 7/1990 Bigelow et al. ..... 226/118.3
5,133,542 A * 7/1992 von Kwiatkowski et al. ..... 271/183
5,239,904 A * 8/1993 Yamaguchi ..... B26D 5/08 83/210
5,685,471 A * 11/1997 Taubenberger ..... B41J 15/06 226/17
5,697,573 A 12/1997 Fukuchi et al.
5,709,352 A * 1/1998 Rogers et al. ..... 242/417.1
5,803,392 A 9/1998 Lancy et al.
5,953,971 A * 9/1999 Jacques ..... 83/27
5,979,308 A 11/1999 Kägi et al.
6,003,420 A * 12/1999 Wakabayashi ..... B26D 9/00 83/214
6,095,391 A * 8/2000 Fiske et al. ..... 226/42
6,256,474 B1 * 7/2001 Gibisch ..... B41J 11/46 226/2
6,418,825 B1 * 7/2002 Hartmann ..... B65H 20/02 83/110
7,101,035 B2 * 9/2006 Oku ..... B65H 5/04 347/104
7,430,948 B2 * 10/2008 De Marco ..... B65H 20/22 83/236
7,611,134 B2 * 11/2009 Sussmeier et al. ..... 270/52.09
7,944,167 B2 * 5/2011 Depoi et al. ..... 318/619
8,708,589 B2 * 4/2014 Mitsuhashi ..... B65H 29/20 400/612
2003/0089209 A1 * 5/2003 Brueckel ..... B65H 20/32 83/76.6
2004/0003692 A1 * 1/2004 Wilhelm ..... D04D 7/10 83/13
2004/0221700 A1 11/2004 Williams et al.
2006/0039738 A1 * 2/2006 Murata ..... B41J 3/4075 400/615.2
2007/0132167 A1 6/2007 Sussmeier et al.
2009/0159631 A1 * 6/2009 DePoi ..... B65H 20/32 226/8
2009/0322275 A1 * 12/2009 DePoi ..... G05B 11/42 318/619
2010/0202818 A1 * 8/2010 Fuchs et al. ..... 400/619

FOREIGN PATENT DOCUMENTS

DE 100 11 006 A1 9/2001
EP 0 658 505 A1 6/1995
EP 0 723 925 A2 7/1996
EP 0723925 A2 * 7/1996
EP 0 858 888 A2 8/1998
EP 1034128 A1 9/2000
EP 1 268 329 B1 1/2003
EP 1449797 A1 8/2004
EP 1 741 653 B1 1/2007
EP 1 798 176 A1 6/2007
GB 898467 A * 6/1962 ..... G06K 13/28
GB 903487 * 8/1962
GB 931208 A * 7/1963 ..... B65H 23/1888
GB 1110545 A * 4/1968
JP 01212891 A * 8/1989 ..... F27D 3/12
JP 05077197 A * 3/1993 ..... B62D 7/02
JP H07-330205 A 12/1995
JP H08-196257 A 8/1996
JP H09-511731 A 11/1997
JP 2002-356045 A 12/2002
WO WO 01/66448 A2 9/2001
WO WO 2004/018167 A1 3/2004
WO 2006/034596 A1 4/2006
WO WO 2009013300 A2 * 1/2009

OTHER PUBLICATIONS

Translation of International Preliminary Report and Written Opinion dated Apr. 19, 20123 in PCT/EP2009/062948; 16 pages.
International Search Report dated Dec. 23, 2010 in PCT/EP2009/062948; 6 pages.

* cited by examiner

DEVICE FOR CUTTING PAPER WEBS

RELATED APPLICATION

This is a U.S. national phase application under 35 U.S.C. § 371 of International Application No. PCT/EP2009/062948 filed Oct. 6, 2009.

TECHNICAL FIELD

The present invention relates generally to a device for cutting paper webs such as in particular a longitudinal and transverse severing device and in particular a device in the buffer region upstream of the transverse severing device, where the paper web or paper webs are longitudinally severed and prepared for cyclic advancement, and a take-off arrangement for the controlled take-off of the cut paper in the region of the transverse severing device.

BACKGROUND AND SUMMARY

Cutting devices have been known for a long time. They are used primarily for cutting printed paper webs, such as are required by large companies in the service field, such as in the finance or insurance sector and administrative companies. These are high-performance paper processing devices which encompass inter alia performance cutting devices and which are designed for operation with the greatest possible level of automation.

To ensure reliable operation at such high throughputs and speeds, it is necessary to take various precautions. For example, smooth and reliable guidance of the paper web is of primary significance. Another problem lies in the supply of paper to the cutting device: to be able to carry out reliable transverse paper severing with a quality adequate for all purposes, and in particular without tear traces, the paper web must be stopped for a brief moment before and during the transverse severing. As a result, the paper web must be moved at different speeds, or passes through different phases of movement, at the location of the transverse severing device. Aside from a phase of constant speed, which in practical operation may be arbitrarily short or negligible, phases of acceleration and a phase of braking to a standstill are also required. This results in an average speed which corresponds to the speed of the paper supply and which constitutes the operational speed of the continuously operating device.

Because said high-performance cutter should operate as continuously as possible and with the least possible interruption, measures must be taken to ensure that the paper web accumulates (braking or holding phase) in a certain region of the processing train or of the cutting device, before the accumulated material is depleted and normal movement (constant speed) is resumed after transverse severing has taken place. Here, it must be ensured that in particular the manner of acceleration does not lead to tearing of the paper web.

DE 100 11 006 discloses a device for cutting paper webs, having a paper deceleration device which is operated by a blower and in which the paper web is guided by means of an air flow, which acts from an underside of the web, through an upwardly directed loop.

The web deceleration, in a device for cutting paper webs, described in EP 1 268 329 or WO 01/66448 is based on precisely this described principle.

Furthermore, EP 1 741 653 describes that, firstly, the paper web is cut longitudinally and, subsequently, the two separate webs are supplied to the transverse severing device via a large, loosely hanging loop. In this device, owing to the relatively large loop, there is the risk of uncontrolled paper supply, and therefore jamming and crumpling.

It is likewise important in this context that, in the following transverse cutting device, the paper webs are stopped only for a very short time for the cutting process, that is to say the transverse severing process must take place as rapidly as possible such that no unnecessary and excessive paper build-up occurs in the supply.

It is therefore a first object of the invention to provide a device in which the coupling of the at least approximately continuous operation at the paper infeed point to the discontinuous operation at the transverse severing device is realized in such a way that no slipping, crumpling or even tearing of the paper web occurs. It is also important that, as a result of the longitudinal severing of the paper web and therefore the merging of the two web parts, the resulting different advancement of the web parts is compensated.

It is a further object of the present invention to keep the interruptions in the discontinuous part, that is to say during the transverse severing, as short as possible and thereby accelerate the take-off off the cut paper.

According to the present invention, there is correspondingly proposed a device for cutting paper webs, having a substantially continuously operated region of the paper supply, a discontinuous region of transverse severing of the paper web, and a buffer region for coupling the regions.

It is proposed that the buffer region which is possibly provided downstream of the longitudinal cutting point between the continuous and discontinuous regions and which serves for coupling the continuous and discontinuous regions has at least one upwardly open, box-like receptacle into which the paper web or paper webs is or are guided in a hanging, looped manner.

A negative pressure can be generated in the receptacle such that the paper web is driven or pulled into the receptacle and if appropriate against the side walls.

It is however also possible for a blower to be provided in the region of the orifice in order to drive the paper web into the receptacle.

In one design variant, the buffer region is arranged downstream of a longitudinal cutting device at which at least two longitudinal webs are produced, whereby at least two separate webs running adjacent to one another are guided in the receptacle, or the two webs are guided in two receptacles arranged adjacent to one another. The arrangement of the buffer region downstream of a longitudinal severing device makes allowance for the problem of two web parts being guided with possibly different advancement to the transverse severing device. Improved buffering between the continuous and discontinuous operation even of the separately moved paper webs is thus ensured.

It is in turn proposed, in a further design variant, that a dividing device such as a dividing screen is provided centrally between the loops of the paper webs in order to prevent adhesion of the loops in the center.

If the one or more receptacles have a U-shaped cross section, it is for example possible for suction orifices and/or a suction fan in the base of the receptacle for the purpose of generating a negative pressure in order to pull the paper webs downward. It is however also possible for suction elements to furthermore be provided in the side walls of the receptacle in order to pull the paper webs against the side walls.

If for example three or more longitudinal webs are produced, it is correspondingly possible for the paper webs thus produced to be looped and pulled into one receptacle, or else three or more receptacles may correspondingly be arranged adjacent to one another or offset with respect to one another in order to pull the respective paper webs into the receptacle for compensation.

In a further design variant of the present invention, it is proposed that, following the buffer zone or the abovementioned receptacles, a so-called braking zone is provided by virtue of a negative pressure being generated along, for example below, the paper webs emerging from the receptacle or receptacles, so as to thus prevent an uncontrolled paper movement. Since the paper webs exiting the buffer zone are briefly stopped and accelerated again in the region of the transverse cutting point, there is the risk of so-called overshooting as the paper webs emerge from the above-described vacuum box, which may lead to bulging or tearing of the paper webs. For this reason, it is proposed according to the invention that for example suction holes are provided, in each case following the so-called vacuum box, in the surface over which the paper webs pass, by means of which suction holes a negative pressure can be generated below the paper web. The negative pressure generated is coupled in terms of control to the transverse cutting process or the transport rollers positioned upstream of the transverse cutting process, such that upon the stopping of the transport or during the paper deceleration, a braking action is generated by means of the negative pressure. During the acceleration of the paper, the negative pressure is eliminated such that the braking action is eliminated, and acceleration can be effected with little force and low web loading.

A further measure according to the invention is proposed in the region of the transverse severing device, for the purpose firstly of guiding one or other or both paper webs optimally into the region of the transverse severing point, of increasing the cutting accuracy, and of removing the cut papers from the cutting region as rapidly as possible and without traces of abrasion. It is proposed here that a transport device positioned downstream of the transverse severing device can be controlled such that it can be at least temporarily deactivated during the feed movement of the paper web imparted by a transport device positioned upstream of the transverse severing device, in such a way that the paper web can be introduced into the region of the transverse severing point without resistance. During or shortly after or shortly before the transverse severing process, said downstream transport device is activated in order to transport the cut paper away. Said transport device may be composed for example of two rollers or drums which engage with one another in order to impart a transporting movement, wherein one drum or roller can be moved away from the other during the introduction of the paper web and is driven against the other roller or drum during transverse severing or shortly after transverse severing has taken place or shortly before transverse severing takes place.

The transverse severing preferably takes place by means of a cutting element which has at least two cutting edges, in such a way that transverse severing of the paper web can be effected during every movement of the cutting element, that is to say upward or downward. Reference is made to WO 2004/018167 which describes a transverse severing device of said type which, in combination with the measures proposed according to the invention, is likewise a constituent part of the present invention.

It is finally proposed that a combining device be provided in the region between the buffer region and transverse severing point, said combining device having oblique sliding tubes and serving to arrange the at least two parallel-running, previously longitudinally severed paper webs so as to run one on top of the other. The sliding tubes are preferably provided with blow air means for preventing smearing or adhesion of the paper webs. Further preferred design variants of the device according to the invention are disclosed hereinafter.

Also proposed is a method for cutting paper webs as described further below. Further design variants of the method according to the invention are also disclosed as set forth in the following Detailed Description.

BRIEF DESCRIPTION OF DRAWINGS

The invention will now be explained in more detail by way of an example and with reference to the appended figures, in which.

DETAILED DESCRIPTION

Figure 1:
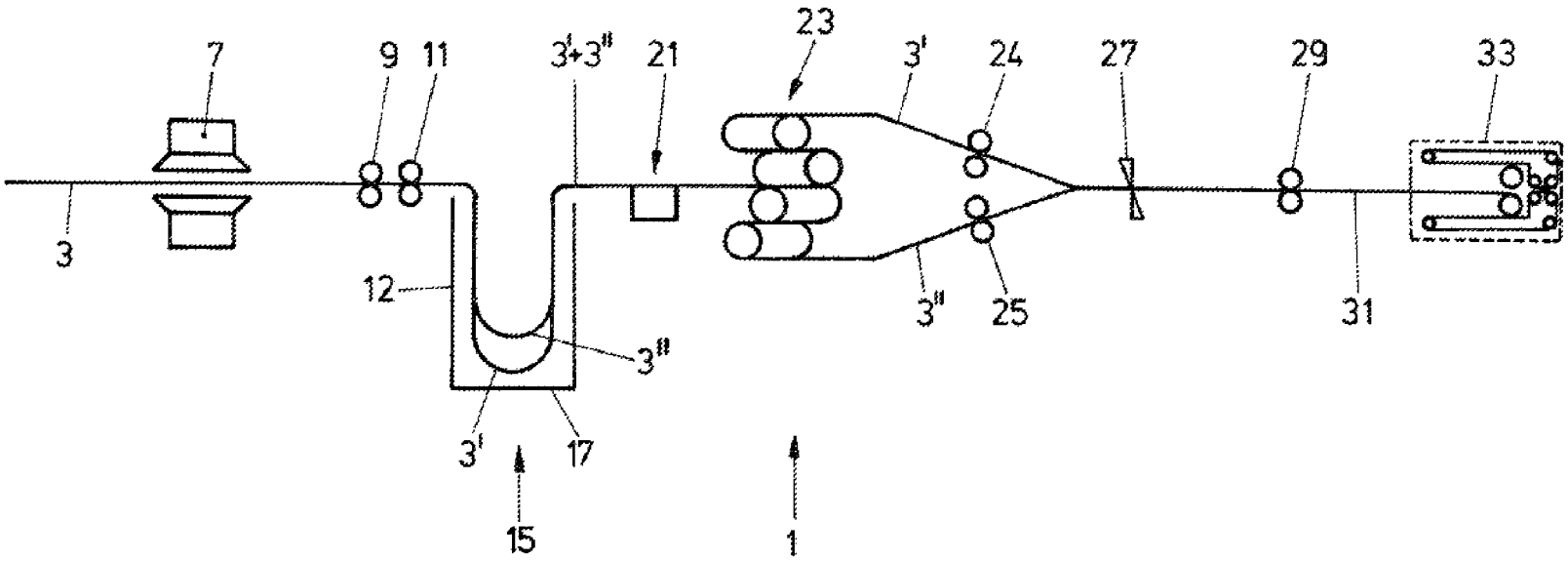
FIG. 1 schematically shows, in longitudinal section, a device according to the invention for longitudinal and transverse severing of paper webs.

FIG. 1 schematically shows, in longitudinal section, a system for cutting paper webs both in the longitudinal direction and in the transverse direction. The paper web 3 is drawn in the form of one or two webs into the cutting system 1 at approximately continuous speed from a stack or from a roller. The infeed point may be equipped with a manual transverse cutting blade in order to facilitate the drawing-in process.

The reading zone 7 is arranged directly downstream of the infeed point and is, in short, designed for reading preferably from above and below over the full width of the form. In a few rare exceptional cases, however, it is necessary to provide a facility for start/stop operation in the case of reduced performance capability in the reading zone.

The paper web is pulled through the infeed point and the reading zone by means of the central drive 9 which follows the reading zone 7. The drive is regulated so as to attain the most uniform web running possible as a function of control information, preferably from the reading process (or page count in the case of applications without reading), application specifications such as form height, speed, acceleration ramps, loop length, etc.

Downstream of the drive, central cutting takes place by means of a so-called central cutting blade 11. The web is punched by the central cutting blade, and the webs which are severed in the center are supplied onward to the buffer zone 15, such as the vacuum box 12 schematically illustrated in FIG. 1. Whether said vacuum box operates by suction from below, for example by means of a suction blower in the base 17, or by means of air being blown in from above, should be optimized in each case on the basis of the given conditions.

An important point of the present invention consists in the novel arrangement of the separate loops, produced by the central cutting process, for the coupling of the continuous operation at the paper infeed point to the discontinuous operation at the downstream, transverse severing point, and the simultaneous solution to the problem of merging the two web parts in 2-up operation with different advancement of the web parts.

Instead of a single vacuum receptacle 12, it is self-evidently also possible for two adjacently arranged receptacles to be provided, which may also be arranged offset with respect to one another in the longitudinal direction of the system.

In contrast to the prior art, the buffer region 15 is arranged downstream of the central cutting point, that is to say, in the vacuum box 12, the two webs have already been severed and the two loops 3' and 3" are arranged adjacent to one another, as a result of which a dual function is realized in the vacuum box:

- compensation of the start/stop operation at the downstream transverse severing point with respect to the approximately constant operation at the entry point,
- compensation of a different advancement of the two separate web parts owing to different advancement of only one or other web in the case of non-conjoint cutting.

The two loops of the two web parts may therefore have a different length. At the entry and exit points, the two loop parts are in the same plane.

Figure 3A:
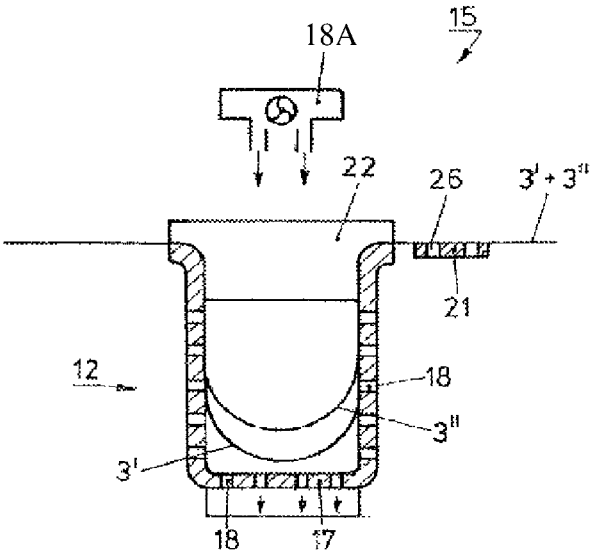
FIG. 3*a* shows the buffer region of the system from FIG. 1 in section and schematically.
Figure 3B:
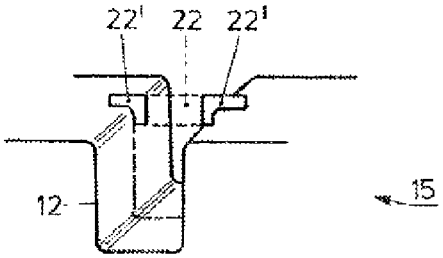
FIG. 3*b* shows, in a perspective view, the buffer region of the system from FIG. 1.

In FIG. 3*a*, the buffer region 15 is schematically illustrated in detail in section. FIG. 3*b* shows the buffer region 15 in a perspective view. Here, similar results can be attained alternatively by blowing the air in from above by means of a blower 18A or by exerting a suction action from below, for example by means of a suction blower, through corresponding orifices 18.

The vacuum box 12 may have, in the center, a vertical dividing screen 22 to prevent adhesion of the two loops in the center. Whether this actually yields two separate vacuum troughs, or said dividing screen is provided only in the upper region, for example in two parts with angle parts 22', may be varied depending on requirements and operation.

Figure 2:
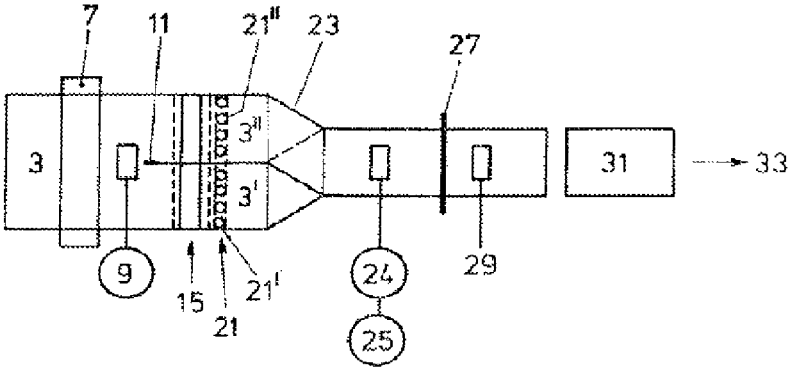
FIG. 2 shows the system from FIG. 1 schematically in a plan view.
Figure 4:
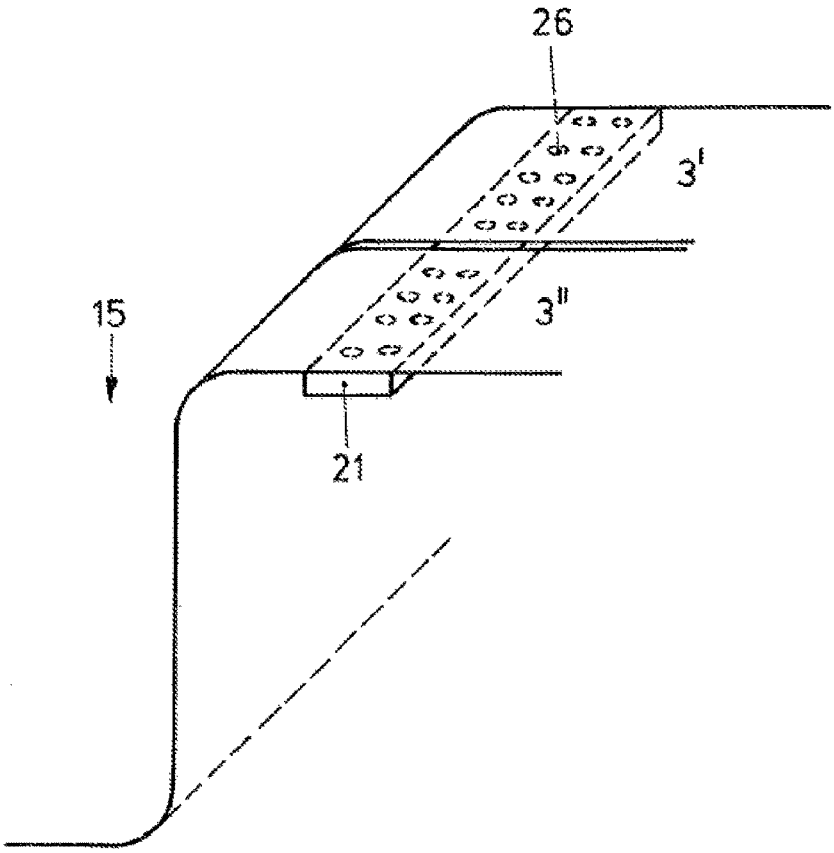
FIG. 4 shows, in a perspective view, the braking device following the buffer region.

Following the buffer region 15, the two paper webs 3' and 3" are guided over a first section 21' and a second section 21" of a so-called controlled braking region 21, as illustrated in a plan view in FIG. 2 and in a perspective view in FIG. 4. The aim of said controlled braking region is to prevent a so-called overshooting of the paper webs when they are in each case stopped for a short moment in the downstream transverse severing region. It is possible, for example, for suction holes 26 to be provided in the contact surface formed by the paper webs 3' and 3", as schematically illustrated in FIG. 4. As shown in FIG. 1, a first section of the braking unit 21 is operationally coupled to a first transport device 24 and a second section of the braking unit 21 is operationally coupled to the second transport device 25. If, therefore, the two paper webs 3' and 3" or in each case only one of these is stopped, for the purpose of carrying out transverse severing of in each case one or both paper webs, by the transport devices 24 and 25 respectively arranged downstream of a so-called merger unit 23, braking of the respective paper web 3' or 3" is realized at the same time by the generation of a negative pressure by the respective first section 21' or second section 21" of the controlled braking region 21. Thus, the braking region 21 selectively halts forward movement of the first and/or second longitudinal webs 3' 3", after the first and/or second longitudinal webs 3' 3" emerge adjacent to each other from the buffer region 15. The great advantage of the braking action proposed according to the invention lies firstly in that the paper web is not bulged during the braking process, and it is not possible for braking elements such as are normally used, such as brushes, rollers and the like, to lead to color smearing of the printed paper webs. It is also possible for the braking action to be eliminated quickly during the acceleration of the paper in order to prevent tearing, whereas a maximum braking action is realized during the paper deceleration.

As already mentioned, following the braking region 21, there is provided a so-called merger unit 23 in which the two paper webs 3' and 3" are guided one on top of the other (in an overlapping arrangement) in different planes for example by means of oblique sliding tubes. Such bringing-together or merging of paper webs guided in parallel is well known from the prior art. To prevent smearing, said sliding tubes of the merger unit 23 are for example provided with blow air means. The web parts emerge from the oblique tubes at different heights, as can be clearly seen from FIG. 1. Said different height is required in order to provide space for the two downstream drives 24 and 25. The merger unit can be adjusted for single-web, logical and non-logical. In the single-web case, tube axes run perpendicular to the web direction.

The two web parts 3' and 3" converge from their two planes at as short a transport distance as possible from the transverse severing device. The two drives 24 and 25 run in start-stop operation. The downstream transverse severing process may be realized for example by means of a conventional cutting element, but it is proposed according to the invention that use be made of a cutting element 27 having two cutting edges 27A and 27B, in such a way that a cutting process can be carried out both during a downward movement and also during an upward movement of the cutting element. Reference is made to the international application WO 2004/018167, in which an advantageous cutting element of said type is described in detail. The content of said patent application is hereby incorporated in the present invention, and is claimed according to the invention in combination with the measures according to the invention for achieving the stated object.

Figure 5:
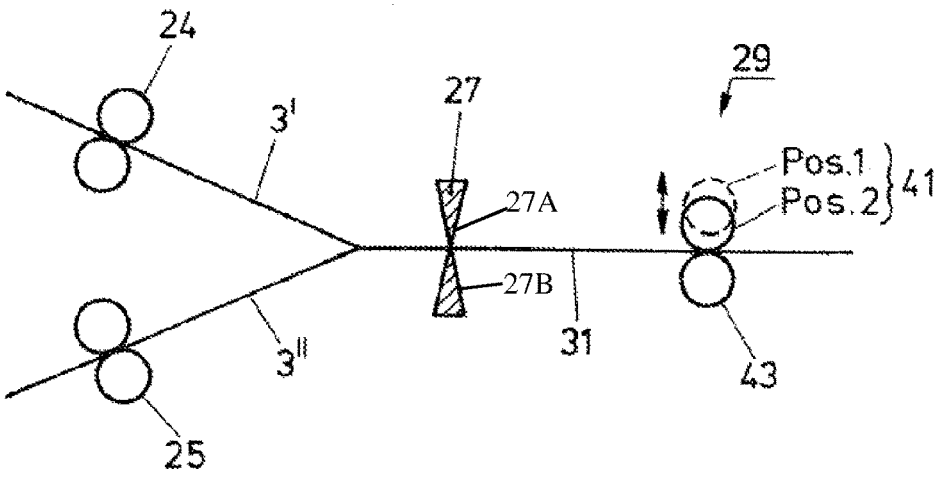
FIG. 5 shows, as a detail, the region of the transverse severing point of the system from FIG. 1 schematically and in section.

A further measure according to the invention will be explained in more detail with reference to FIG. 5, which illustrates in detail the region of the transverse severing point. The supply of either the paper web 3' or 3" or both paper webs simultaneously is realized by means of the drives 24 and 25 which guide the respective paper web into the region of the transverse severing unit 27. During the forward transport of the paper webs, the transport device 29 arranged downstream of the transverse severing device is deactivated for example by virtue of a guide roller or guide drum 41 being arranged remote from the drive drum or drive roller 43 in position 1, such that the paper web can be pushed without resistance through the gap thus formed. Only shortly before or during the cutting process, or during or shortly after the end of the cutting process by means of a severing blade 27, for example, is the guide drum or roller 41 driven against the drive drum or roller 43 in position 2, as a result of which the paper 31, which has now been cut, is transported away. The mode of operation of the transport device 29 may however also be such that the uncut web is transported through the take-off rollers after the cut sheet 31 has been transported away. The take-off roller is then raised, as described in the introduction, in order that the web can stretch without resistance at least shortly before the cutting process. The take-off or guide drum 41 is first applied, that is to say driven against the drive drum 43, during the cutting process. It is however also conceivable for this to take place already entirely before the cutting process in order to fix the cut sheet. In other words, the transport devices 24 and 25, on the one hand, and the transport device 29 having the two rollers or drums 41 and 43, on the other hand, are operated synchronously.

The great advantage of this type of take-off compared with take-off devices used nowadays is that simpler synchronization of advancement and take-off is possible, the paper webs need not be driven through a so-called slippage between the two rollers or drums, the cutting accuracy can be increased, multiple paper webs simultaneously can be synchronized with one cut mark, and the system is not made overdeterminate through the use of multiple advancement means and only one take-off.

The system described with reference to FIGS. 1 to 4 is focused on so-called 2-up operation. This corresponds to the standard nowadays. The system described according to the invention takes into consideration the problem arising as a result of the so-called 2-up operation, because the merging of two parallel webs is necessary. In contrast, 1-up processing, for example, constitutes merely a trivial special situation in which single-web operation is possible without problems by removing the central cutting blade and setting the sliding tubes straight in the merger.

The system described with reference to FIGS. 1 to 4 is also suitable for two-channel operation, assuming that a two-channel entry is provided. Correspondingly, it is necessary for a second drive to be provided in the entry region, for example by virtue of the existing central drive being offset laterally and a second drive being provided. It is self-evidently also possible for 3, 4 or more webs to be guided parallel and adjacent to one another, be it simply through the supply of multiple webs or else through multiple longitudinal cutting of one or two webs.

The system illustrated in FIGS. 1 to 4 serves primarily for explaining the present invention. The system may self-evidently be of some other design or supplemented by further elements. The selected system parts may also be modified. With regard to the present invention, it is proposed firstly that the buffer designed according to the invention be provided between the regions of continuous and discontinuous operation in order to compensate the substantially continuous advancement with respect to the discontinuous operation. Furthermore, the controlled braking following the buffer region is provided in order to attain controlled braking of the paper webs, and finally, the controlled take-off and the synchronization of the advancement and take-off in the region of the transverse severing point are provided in accordance with the invention.

The invention claimed is:

1. An apparatus for cutting a paper web that is continuously supplied from upstream, along a path of travel, to downstream, said apparatus comprising:

a longitudinal cutting device for cutting the paper web as the paper web is continuously supplied to the longitudinal cutting device, to produce at least a first longitudinal web and a second longitudinal web;

a buffer unit comprising at least one upwardly open receptacle, having side walls and a base, into which each of the first and second longitudinal webs running adjacent to one another is guided;

a braking unit configured to perform each of halting downstream travel of only the first longitudinal web, halting downstream travel of only the second longitudinal web, and halting downstream travel of both the first and second longitudinal webs, after the longitudinal webs emerge, adjacent to each other, from the buffer unit;

a merger unit, in which the first longitudinal web is guided on top of the second longitudinal web so that the first and second webs are overlapping;

a first transport device and a second transport device, which drive the first and second longitudinal webs, respectively, according to a start-stop operation, to draw the longitudinal webs out of the merger unit in an overlapping configuration, said first and second transport devices being operationally coupled to the braking unit in such a way that, when the first and/or second transport device drives one of the overlapping first and second longitudinal webs forward, said braking device releases the respective, adjacent first and/or second longitudinal web to allow forward movement of the respective web; and a transverse severing device for severing the overlapping first and second longitudinal webs;

wherein the longitudinal cutting device, buffer unit, braking unit, merger unit, first and second transport devices, and transverse severing device are arranged along the path of travel of the paper web from upstream to downstream in sequential order.

2. The apparatus as claimed in claim 1, wherein the first transport device is separate from the second transport device.

3. The apparatus as claimed in claim 1, wherein the first and second longitudinal webs are located side-by-side in the buffer unit and in the braking unit.

4. The apparatus as claimed in claim 1, wherein the first transport device and the second transport device are adapted to operate independently from each other, so as to drive the first and second longitudinal webs, respectively, in a non-simultaneous manner.

5. The apparatus as claimed in claim 1, wherein the braking unit is adapted to selectively apply negative pressure to the first and/or second longitudinal web in order to halt forward movement of the first and/or second longitudinal web.

6. The apparatus as claimed in claim 1, wherein the buffer unit comprises at least two of said receptacles into which the first and second longitudinal paper webs are respectively guided, the at least two receptacles being arranged adjacent to or offset with respect to one another.

7. The apparatus as claimed in claim 1, wherein the buffer unit further comprises means for generating a negative pressure in the at least one receptacle in order to drive or pull the paper webs into the at least one receptacle and against side walls of the at least one receptacle.

8. The apparatus as claimed in claim 7, wherein the means for generating negative pressure in the at least one receptacle comprises a blower for driving the paper webs into the at least one receptacle by blowing air in from above.

9. The apparatus as claimed in claim 7, wherein the means for generating the negative pressure in the at least one receptacle includes suction elements provided in the side walls and/or the base of the at least one receptacle.

10. The apparatus as claimed in claim 1, wherein, in the at least one receptacle, a dividing device is inserted centrally from above between the adjacently configured first and second longitudinal webs in order to prevent tangling of the longitudinal webs in the buffer unit.

11. The apparatus as claimed in claim 1, further comprising a further transport device downstream of the transverse severing device and comprising at least two transport rollers or drums, wherein one roller or drum is, when deactivated, positioned remote from the other roller or drum so as to allow the first and/or second longitudinal paper web to pass through at least temporarily without resistance.

12. The apparatus as claimed in claim 11, wherein the first and/or second transport device is coupled in terms of movement to the further transport device, in such a way that the further transport device is at least temporarily activated when the first and/or second transport device is driving, and said further transport device is first activated shortly before, during or immediately after transverse severing has taken place, in order to move the cut paper away from the transverse severing device.

13. The apparatus as claimed in claim 1, wherein the transverse severing device includes at least one cutting element which has at least two cutting edges, wherein transverse severing of the paper web takes place both during a downward movement and during an upward movement of oscillating movements upward and downward of the at least one cutting element.

14. The apparatus as claimed in claim 1, wherein the first transport device and the second transport device are configured to perform each of driving downstream travel of only the first longitudinal web, driving downstream travel of only the second longitudinal web, and driving downstream travel of both the first and second longitudinal webs simultaneously.

* * * * *